US007156427B2

(12) United States Patent
Kulajew

(10) Patent No.: US 7,156,427 B2
(45) Date of Patent: Jan. 2, 2007

(54) SAFETY LOCKING DEVICE FOR A CONTAINER IN A VEHICLE

(75) Inventor: Viktor Kulajew, Baierbronn (DE)

(73) Assignee: Fischer Automotive Systems GmbH, Horb (DE)

( * ) Notice: Subject to any disclaimer, the term of this patent is extended or adjusted under 35 U.S.C. 154(b) by 0 days.

(21) Appl. No.: 10/516,048

(22) PCT Filed: May 30, 2003

(86) PCT No.: PCT/EP03/05656

§ 371 (c)(1),
(2), (4) Date: Nov. 29, 2004

(87) PCT Pub. No.: WO03/104591

PCT Pub. Date: Dec. 18, 2003

(65) Prior Publication Data

US 2005/0173931 A1 Aug. 11, 2005

(30) Foreign Application Priority Data

Jun. 5, 2002 (DE) ..... 102 24 862

(51) Int. Cl.
*E05B 65/10* (2006.01)

(52) U.S. Cl. ..... 292/92; 292/DIG. 4; 292/DIG. 22; 292/231

(58) Field of Classification Search ..... 292/106, 292/DIG. 4, DIG. 22, 238, 231 X
See application file for complete search history.

(56) References Cited

U.S. PATENT DOCUMENTS

| | | | | |
|---|---|---|---|---|
| 4,552,399 | A * | 11/1985 | Atarashi | 296/37.12 |
| 4,973,014 | A * | 11/1990 | Daigle et al. | 248/62 |
| 5,052,728 | A * | 10/1991 | Fukumoto | 292/106 |
| 5,292,159 | A * | 3/1994 | Sandhu et al. | 292/173 |
| 5,312,143 | A * | 5/1994 | Buckner | 292/230 |
| 5,597,188 | A * | 1/1997 | Miche | 292/183 |
| 6,851,730 | B1 * | 2/2005 | Haab et al. | 292/103 |
| 2002/0171251 | A1 | 11/2002 | Bieck et al. | |

FOREIGN PATENT DOCUMENTS

| | | |
|---|---|---|
| DE | 94 12 661.5 | 11/1994 |
| DE | 101 20 435 A1 | 10/2002 |
| DE | 10121681 | 11/2002 |
| EP | 0 610 882 A2 | 8/1994 |

* cited by examiner

*Primary Examiner*—Brian E. Glessner
*Assistant Examiner*—Mark Williams
(74) *Attorney, Agent, or Firm*—Michael J. Striker

(57) ABSTRACT

A safety locking mechanism (24) for a receptacle (10) in a vehicle includes a moveable mass (28) which is held in a home position by a snap-in device (28, 30, 34, 38) and which is deflected when acted upon by high acceleration or deceleration as occurs in an accident. A snap-in device (28, 30, 34, 38) also holds the mass (28) in the deflected position. In the deflected position, the mass (28) locks the receptacle (10).

4 Claims, 2 Drawing Sheets

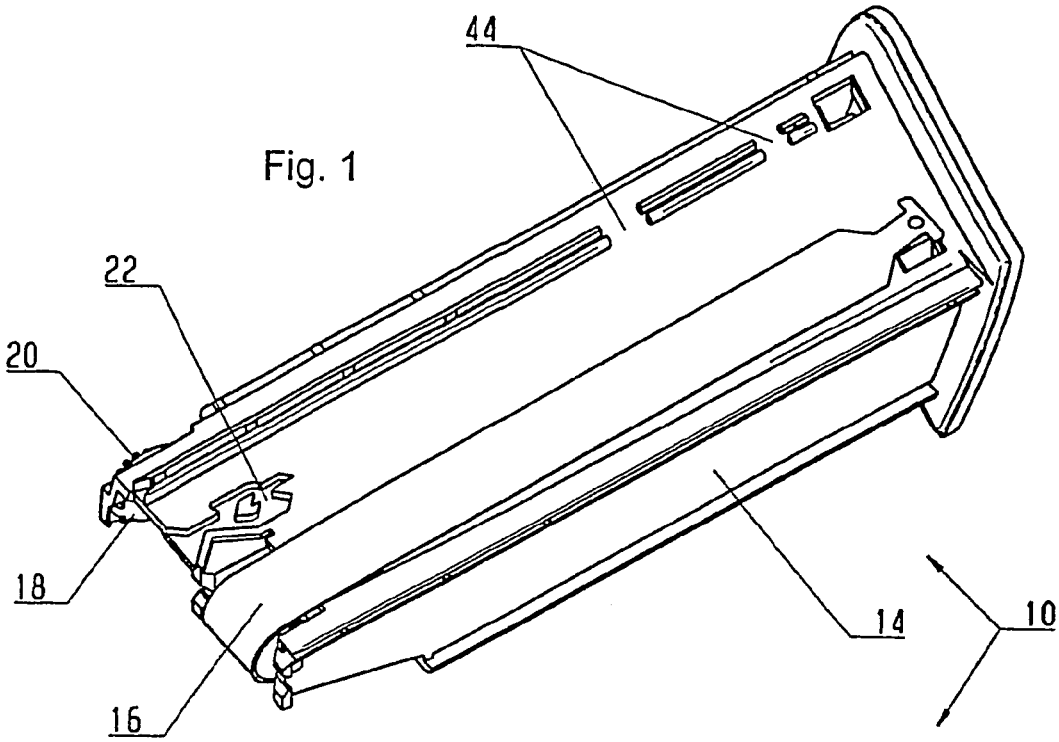
Fig. 1
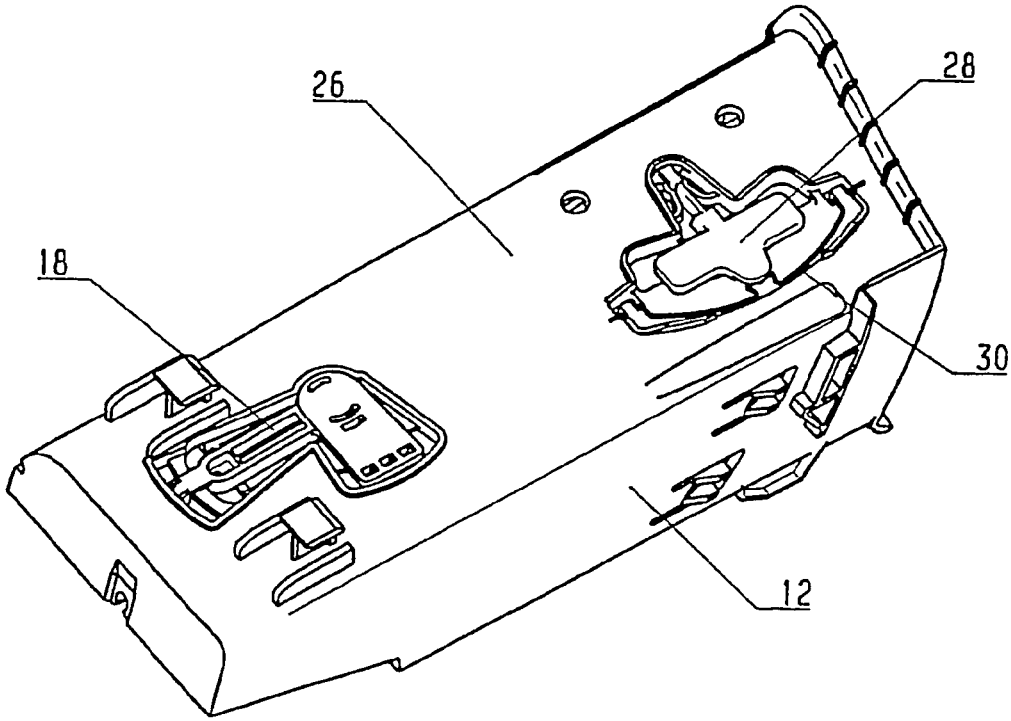

SAFETY LOCKING DEVICE FOR A CONTAINER IN A VEHICLE

CROSS-REFERENCE

The invention described and claimed hereinbelow is also described in German Patent Application DE 10224 862.1, filed Jun. 5, 2002. This German Patent Application, whose subject mailer is incorporated here by reference, provides the basis for a claim of priority of invention under 35 U.S.C. 119 (a)–(d).

BACKGROUND OF THE INVENTION

The invention relates to a safety locking mechanism for a receptacle in a vehicle.

The safety locking mechanism is intended especially for a motor vehicle. A receptacle can be, for example, a storage compartment having an insert which can be moved outwards in the manner of a drawer. It is likewise possible for a cover of a storage or glove compartment or, instead of a receptacle, e.g. a slider of a drinks holder to be locked in a closed position in the event of an accident, using the safety locking mechanism according to the invention.

Safety locking mechanisms are known per se. Their purpose is to prevent a receptacle from opening, especially to prevent a slider from moving outwards, in the event of an accident, especially in the case of impact from the front and/or the rear. The intention is to prevent sliders, covers or like parts from projecting out into the passenger space and thereby creating a risk of injury to occupants. In addition, the intention is to prevent articles kept in a receptacle from entering the internal space of the vehicle as a result of opening of the receptacle and from flying about therein and creating a risk of injury.

A safety locking mechanism of such a kind is disclosed in EP 610 882 A2. The said publication discloses a receptacle having an insert which can be moved outwards in the manner of a drawer and which is urged into an open position by means of a spring element. A so-called push-push locking mechanism holds the insert in a pushed-in, closed position against the force of the spring element. The locking mechanism has a hook-shaped, spring-loaded locking element. For developing the locking mechanism into a safety locking mechanism, the said publication proposes so arranging the hook-shaped locking element by means of shaping or an eccentrically disposed weight that acceleration or deceleration acting on the locking element in the event of an accident biases the locking element against the spring force of the spring element. As a result, acceleration or deceleration which is applied in the event of an accident prevents the locking element from becoming disengaged from the insert.

U.S. Pat. No. 5,052,728 discloses another safety locking mechanism. In that case, a displaceably guided mass prevents an again hook-shaped locking element from pivoting and consequently prevents a compartment which can be moved outwards in the manner of a drawer from becoming disengaged, the mass moving against the force of a spring element in the event of an accident.

SUMMARY OF THE INVENTION

The invention is based on the problem of proposing a safety locking mechanism of the kind mentioned hereinbefore wherein the safety provided against opening of a receptacle as a result of an accident is increased.

The safely locking mechanism according to the invention has a mass which is guided by a guide means so that it can move from a home position into a deflected position. The guide means can be a straight or non-straight slideway. Also possible is a pivotal mounting, which guides the mass so that it can move along a course in the shape of an arc of a circle. Furthermore, the safely locking mechanism according to the invention has a device which holds the mass in a home position when no acceleration or deceleration acts on the mass in the deflecting direction. The device can comprise, for example, a spring element which holds the mass against a stop when no acceleration/deceleration acts on the mass. Acceleration/deceleration can move the mass against the force of the spring element in one direction, that is to say can deflect it. It is also possible for the mass to be held, by means of a spring element, in a home position in which the spring element is relaxed. Deflection of the mass as a result of acceleration/deceleration is possible in two mutually opposite directions, and also, possibly, in one or more transverse directions.

The invention furthermore provides a snap-in device which holds the mass in the deflected position once the mass has been moved into the deflected position as a result of acceleration or deceleration acting on it. In that position, the mass holds the receptacle closed. As a result, the mass can hold the receptacle closed directly or also indirectly by way of, for example, a locking element. The snap-in device also holds the receptacle closed when the acceleration/deceleration is no longer active. As a result, the receptacle can no longer be opened after an accident, or at least before the receptacle is opened the snap-in device has to be released, for example manually. As a result, the invention prevents the receptacle from opening as a result of, for example, jolts in the course of an accident or also a series of accelerations and decelerations in the event of, for example, impact from the front and subsequently from the rear. The device holding the mass in the home position is so arranged that the mass can be moved into the deflected position only as a result of acceleration or deceleration which exceeds a predetermined value. That value is selected to be so high that accelerations and decelerations occurring in normal driving operation do not move the mass into the deflected position even in the event of, for example, sharp braking or sharp acceleration. The mass is accordingly brought into the deflected position only as a result of acceleration or deceleration as occurs in the event of an accident.

In an embodiment of the invention, the mass is arranged to be deflected in two opposite directions, is held in each of the two deflected positions by a snap-in device and in each deflected position holds the receptacle closed. The two directions are preferably so selected that acceleration or deceleration in the longitudinal direction of the vehicle deflects the mass. The safety locking mechanism will, as a result, be effective in the event of impact from the front or the rear. If the safety locking mechanism is also to be effective in the case of impact from the side, a longitudinal and transverse guide means or a guide means for the mass having degrees of freedom in the longitudinal and transverse directions can be provided or a second safety locking mechanism can be provided for the transverse direction. The mass can be held in each deflected position by a snap-in device or a snap-in device is provided which holds the mass in each deflected position.

The device holding the mass in the home position can be, for example, a spring element, against the force of which the mass can be deflected. Only when the deflection exceeds a predetermined distance and, consequently, a predetermined force does the snap-in device which holds the mass in the deflected position become effective. As a result, it is ensured that only acceleration or deceleration as occurs in the event of an accident and not acceleration or deceleration as occurs during normal driving operation can snap the mass into the snap-in device in the deflected position.

In an embodiment of the invention, the device holding the mass in the home position is also arranged as a kind of snap-in device, from which the mass is released only when the acceleration or deceleration acting on it exceeds a threshold value. That also ensures that the safety locking mechanism according to the invention comes into effect only in the event of an accident and not during normal driving operation. As a result of a snap-in device or the like, it is possible for the threshold value of the acceleration or deceleration necessary for deflection of the mass to be predetermined more exactly and, as a result, for a malfunction to be avoided with greater reliability. Malfunctions can be both the receptacle's being held closed by accelerations or decelerations occurring in normal driving operation and also the receptacle's not being held closed in the event of an accident.

In an embodiment of the invention, a spring element is provided which forms both the device holding the mass in the home position and also the snap-in device holding the mass in the deflected position. This embodiment of the invention provides the possibility of constructing the safety locking mechanism simply and at reasonable cost. As spring elements there also come into consideration, besides metal spring elements, plastics or other spring elements.

BRIEF DESCRIPTION OF THE DRAWINGS

The invention is described below in greater detail with reference to an exemplary embodiment illustrated in the drawings, in which:

FIG. 1 is a partially broken away, exploded perspective view of a receptacle which can be opened, having a safety locking mechanism according to the invention;

DETAILED DESCRIPTION OF THE PERFERRED EMBODIMENTS

Figure 2:
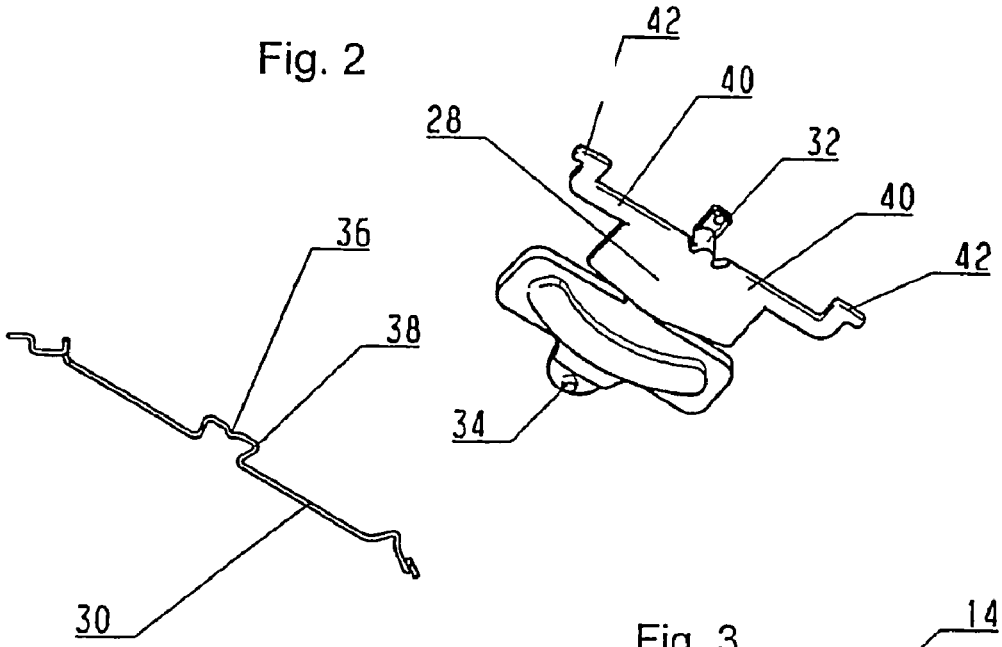
FIG. 2 shows individual parts of the safety locking mechanism of the receptacle of FIG. 1.

The receptacle 10 shown in FIG. 1 has a housing 12 and an insert 14. The housing 12 is box-shaped and open at its front face. The insert 14 is likewise box-shaped and open at its top face. The insert 14 is displaceably accommodated in the housing 12 in the manner of a drawer. The housing 12 is intended to be inserted into an installation opening provided for the purpose in a dashboard (not shown) of a motor vehicle (not shown).

For excursion of the insert 14 into an opened position projecting out from the front face of the housing 12, the receptacle 12 has a scroll spring 16, which is rotatably mounted at the rear face of the insert 14 so that it can be unwound. For damping the excursion movement, a rotation damper known per se (not shown in the drawing) is set into a side wall of the insert 14. A toothed wheel 20 of the rotation damper meshes with a toothed rack (not shown) on the housing 12. A locking mechanism 18, 22 holds the insert 14 against the force of the scroll spring 16 in a closed position pushed into the housing 12. Such locking mechanisms 18, 22 are known per se as push-push or heart-shaped curve locking mechanisms. They can be released by pressing the insert 14 a short distance further into the housing 12 from the closed position.

The receptacle 10 has a safety locking mechanism according to the invention, which is arranged on the underside of the bottom 26 of the housing 12. The safety locking mechanism has a mass in the form of a weight 28 and a spring element 30, which is bent from a spring wire. The weight 28 and the spring element 30 are shown as individual parts in FIG. 2, although FIG. 2 shows the weight 28 and the spring element 30 from the other side to FIG. 1. The weight 28 has, at a side edge, a mounting projection 32, which is accommodated in a mounting hole in the base 26 of the housing 12. By that means, the weight 28 is mounted in the base 26 of the housing 12 so that it can pivot about the mounting projection 32. That pivot mounting of the weight 28 forms a guide means, by which the weight 28 is guided on a course in the shape of an arc of a circle about the mounting projection 32 so that it is movable approximately forwards and backwards in relation to the housing 12.

On its side located opposite the mounting projection 32, the weight 28 has a snap-in projection 34, which co-operates with the spring element 30: the spring element 30 has, in its middle, a curve 36 in which the snap-in projection 34 is located. The spring element 30, together with its curve 36 and the snap-in projection 34 of the weight 28, forms a snap-in device 28, 30, 34, 38, which holds the weight 28 in a home position. When a force of sufficient magnitude in a forwards or backwards direction in relation to the housing 12 acts on the weight 28, the snap-in projection 34 is released from the curve 36 and the weight 28 can pivot forwards or backwards. In the position inserted in the housing 14, the spring element 30 is resiliently curved in an arcuate shape, whereas in the relaxed state (FIG. 2) it is substantially straight.

The spring element 30 has, also in its middle, a trapezoidal or swallowtail-shaped bend 38, in the middle of which the curve 36 is located. The sides of the trapezoidal or swallowtail-shaped bend 36 form undercuts, into which the snap-in projection 34 can snap. If the weight 28 pivots forwards or backwards, its snap-in projection 34 arrives at one of the two sides of the trapezoidal or swallowtail-shaped bend 38 of the spring element 30, where it is held snapped in place. Consequently, the weight 28 can no longer pivot back. The spring element 30, together with its trapezoidal or swallowtail-shaped bend 38, and the weight 28, together with its snap-in projection 34, consequently form a further snap-in device 28, 30, 34, 38, which holds the weight snapped into place in the position pivoted forwards or backwards, that is to say in the deflected position. It is not intended that the weight 28 be pivoted back into its home position. In order to pivot the weight 28 back into its home position, the spring element 30 would have to be bent sideways, for which purpose the spring element 30 arranged on the underside of the base 26 of the housing 12 would have to be accessible or made accessible, for example by removing the receptacle 10 from the dashboard (not shown). The highest accelerations and decelerations occurring in normal driving operation are not sufficient to cause the snap-in projection 34 of the mass 28 to snap out from the curve 36 of the spring element 30.

The weight 28 has two arms 40, which project out integrally from the weight 28 in extension of that side of the weight 28 on which the mounting projection 32 is provided. The arms 40 have cranked bends 42 at their free ends. When the weight 28 has been deflected, that is to say pivoted forwards or backwards, the cranked bend 42 of an arm 40 engages in a space 44 in the insert 14. As a result, the insert 14 is locked in its closed position inserted in the housing 12.

Figure 3:
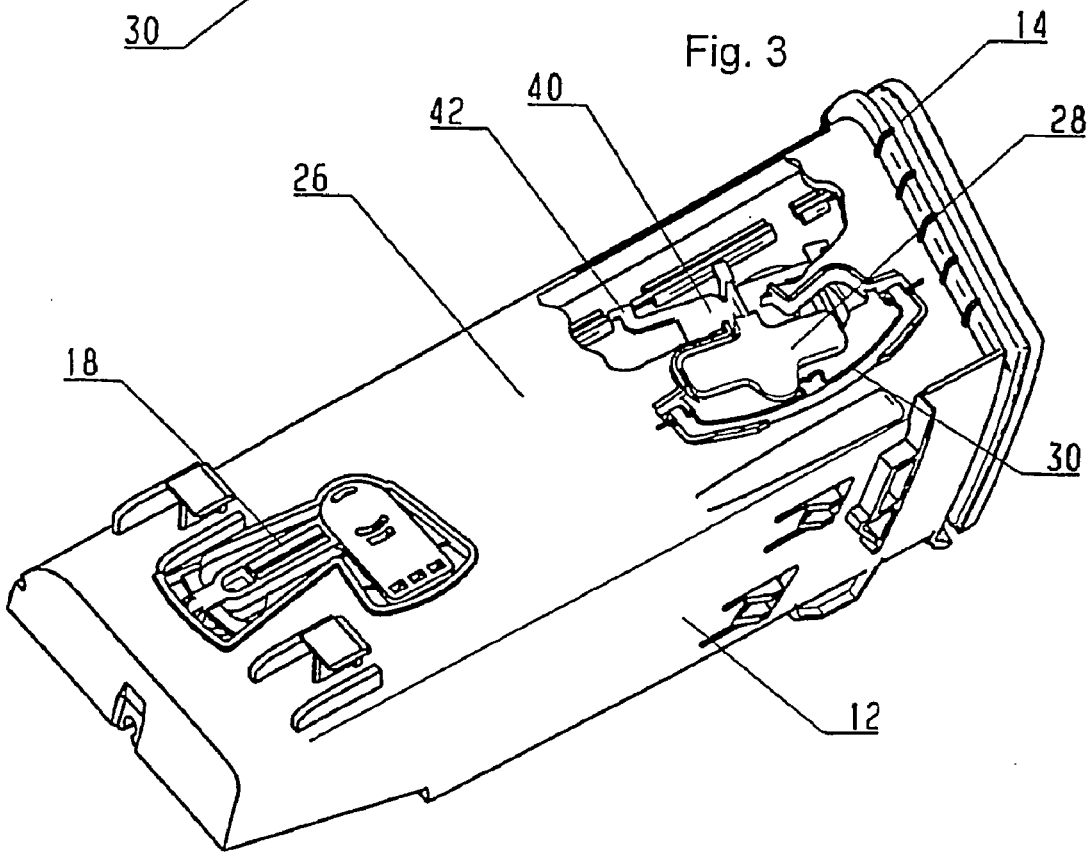
FIG. 3 shows a housing of the receptacle of FIG. 1 in the same perspective, together with a mass in the deflected position.

The safety locking mechanism 24 according to the invention functions as follows: when acceleration or deceleration in a forwards or backwards direction is exerted on the weight 28 as a result of impact from the front or the rear to a motor vehicle in which the receptacle 10 is installed, the snap-in projection 34 of the weight 28 snaps out of the curve 36 in the spring element 30, the weight 28 pivots and the cranked bend 42 of one of its arms 40 locks the insert 14 in the housing 12. At the same time, the snap-in projection 34 snaps into one side of the trapezoidal or swallowtail-shaped bend 38 in the spring element 30 so that the weight 28 remains pivoted, that is to say deflected, even when the acceleration or deceleration decreases or acts in the opposite direction. As a result, the insert 14 remains locked in the closed position in the housing 12 during and after an accident. FIG. 3 shows one of the two deflected positions of the weight 28.

The invention claimed is:

1. Safety locking mechanism for a receptacle in a vehicle, having a mass which is guided by a guide means so that it can move in the receptacle from a home position into a deflected position and in the deflected position directly locks with the receptacle and holds the receptacle closed and having a device which holds the mass in the home position when no acceleration or deceleration acts on the mass in the deflection direction, wherein the safety locking mechanism (24) has a snap-in device (28, 30, 34, 38) which holds the mass (28) in the deflected position, and wherein the safety locking mechanism (24) has an element that forms the device which holds the mass in the home position and also the snap-in-device which holds the mass in the deflected position.

2. Safety locking mechanism for a receptacle in a vehicle, having a mass which is guided by a guide means so that it can move from a home position into a deflected position, the mass holding the receptacle closed when the mass has been moved into the deflected position, and having a device which holds the mass in the home position when no acceleration or deceleration acts on the mass in the deflection direction, wherein the safety locking mechanism (24) has a snap-in device (28, 30, 34, 38) which holds the mass (28) in the deflected position, wherein the mass (28)is arranged to be deflected in two opposite directions, is held in each deflected position by a snap-in device (28, 30. 34, 38) and in each deflected position holds the receptacle (10) closed.

3. Safety locking mechanism according to claim 1, wherein the device (28, 30, 34, 38) holding the mass (28) in the home position holds the mass (28) in the home position for as long as acceleration or deceleration acting on the mass (28) in the deflection direction does not exceed a threshold value.

4. Safety locking mechanism according to claim 1, wherein the element of the safety locking mechanism (24) a spring element (30) which forms the device (28, 30, 34, 38) holding the mass (28) in the home position and the snap-in device (28, 30, 34, 38) holding the mass (28) in the deflected position.

* * * * *